United States Patent [19]

Kawamura et al.

[11] Patent Number: 4,846,672

[45] Date of Patent: Jul. 11, 1989

[54] COMBUSTION CYLINDER STRUCTURE FOR OIL BURNER

[75] Inventors: Masanori Kawamura, Mie; Takashi Kawai, Aichi, both of Japan

[73] Assignee: Toyotomi Kogyo Co., Ltd., Japan

[21] Appl. No.: 226,092

[22] Filed: Jul. 29, 1988

[30] Foreign Application Priority Data

Jul. 31, 1987 [JP] Japan ..... 62-118303[U]

[51] Int. Cl.[4] ..... F23D 5/00

[52] U.S. Cl. ..... 431/201; 431/309; 431/313; 431/314; 126/96

[58] Field of Search ..... 431/302, 303, 309, 312, 431/314, 320, 344, 201, 313; 126/96, 97

[56] References Cited

U.S. PATENT DOCUMENTS 4,498,862 2/1985 Nakamura et al. ..... 126/96 X
4,569,652 2/1986 Nakamura et al. ..... 126/96 X
4,790,745 12/1988 Nakanishi et al. ..... 126/96 X

FOREIGN PATENT DOCUMENTS 23477 12/1962 Japan .
59764 12/1982 Japan .

*Primary Examiner*—Randall L. Green
*Attorney, Agent, or Firm*—Pollock, Vande Sande & Priddy

[57] ABSTRACT

A combustion cylinder structure for an oil burner capable of decreasing in the number of used parts to simplify its construction and assembling. A flame spreading cylinder arranged in an inner cylindrical member downwardly extends through a partition plate arranged in a lower end of the inner cylindrical member into a wick receiving cylinder structure. The flame spreading cylinder is concentratedly formed with a plurality of vent holes at a portion thereof in proximity to a flame spreading plate mounted on the cylinder. The partition plate is formed with a plurality of small through-holes and an inner top plate mounted on the inner cylindrical member is formed with a plurality of small through-holes. The flame spreading cylinder, outer top plate and inner top plate cooperate together to define a space to which air is supplied via the small through-holes of the partition plate and inner top plate.

7 Claims, 2 Drawing Sheets

COMBUSTION CYLINDER STRUCTURE FOR OIL BURNER

BACKGROUND OF THE INVENTION

1. Field of the Invention

This invention relates to a combustion cylinder structure for an oil burner, and more particularly to a combustion cylinder structure equipped with a flame spreading device which is adapted to be used for an oil burner of the wick ignition type.

2. Description of the Prior Art

A conventional combustion cylinder structure of such type which has been widely known in the art is disclosed in Japanese Utility Model Publication No. 23477/1962 or Japanese Utility Model Publication No. 59764/1982. Although the conventional combustion cylinder structure contributes to an improvement in a wick moving mechanism or an oil reservoir structure, it fails in its own improvement. More particularly, in the conventional structure, a multiple combustion cylinder comprising inner and outer cylindrical members and an outermost cylinder is arranged separate from a flame spreading section provided above the multiple combustion cylinder, and combustion air for the flame spreading section is supplied thereto while being regulated by small through-holes of a top plate of the inner cylindrical member. Such construction of the conventional combustion cylinder structure causes the number of parts used to be highly increased, resulting in assembling of the structure being highly troublesome and an increase in manufacturing cost.

Also, the conventional combustion cylinder structure necessarily requires a cross pin for the purpose of concentrically supporting the cylindrical members and outermost cylinder of the structure on a wick receiving cylinder. Unfortunately, the cross pin not only causes the combustion cylinder structure to be further complicated in construction but prevents smooth and uniform flowing of combustible gas formed in the structure to lead to a failure in uniform and stable combustion at the flame spreading section.

Accordingly, it would be highly desirable to develop to a combustion cylinder structure for an oil burner which is capable of decreasing the number of used parts to lead to simplification in its construction and assembling and ensuring uniform combustion.

SUMMARY OF THE INVENTION

Generally speaking, in accordance with the present invention, a combustion cylinder structure for an oil burner is provided. The combustion cylinder structure includes a multiple combustion cylinder comprising a perforated inner cylindrical member, a perforated outer cylindrical member and an outermost cylinder concentrically arranged together so as to define first and second spaces therebetween, respectively, and supported on a wick receiving cylinder structure of the oil burner. The structure also includes a combustion chamber defined above the multiple combustion cylinder. On the inner cylindrical member is mounted an inner top plate of an annular shape so as to inwardly extend therefrom, and in a lower end of the inner cylindrical member fitted a partition plate of an annular shape. The structure further includes a flame spreading cylinder fixedly arranged in the inner cylindrical member so as to upwardly extend through the inner top plate and inner cylindrical member into the combustion chamber and a flame spreading plate of a circular shape mounted on an upper end of the flame spreading cylinder and arranged in the combustion chamber. The flame spreading plate has an outer periphery extending to a position above the first space between the inner cylindrical member and the outer cylindrical member. On an upper end of the outer cylindrical member is mounted an outer top plate of an annular shape which has an inner peripheral end extending to a position above the first space and positioned between the inner top plate and the flame spreading plate.

The flame spreading cylinder is also arranged so as to downwardly extend through the partition plate into the wick receiving cylinder structure. Also, the flame spreading cylinder is concentratedly formed with a plurality of vent holes at a portion thereof in proximity to the flame spreading plate. The partition plate is formed with a plurality of small through-holes and the inner top plate is formed with a plurality of small through-holes. The flame spreading cylinder, outer top plate and inner top plate cooperate together to define a space to which air is supplied via the small through-holes of the partition plate and inner top plate.

Accordingly, it is an object of the present invention to provide a combustion cylinder structure for an oil burner which is capable of decreasing in the number of parts used.

It is another object of the present invention to provide a combustion cylinder structure for an oil burner which is capable of eliminating use of a cross pin for concentrically supporting a multiple combustion cylinder.

It is a further object of the present invention to provide a combustion cylinder structure for an oil burner which is capable of simplifying its construction and assembling.

It is still another object of the present invention to provide a combustion cylinder structure for an oil burner which is capable of being manufactured at a low cost.

It is still a further object of the present invention to provide a combustion cylinder structure for an oil burner which is capable of ensuring uniform and stable combustion.

Still other objects and advantages of the invention will inpart be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like parts throughout; wherein.

DETAILED DESCRIPTION OF THE PREFERRED EMBODIMENT

Now, a combustion cylinder structure for an oil burner according to the present invention will be described hereinafter with reference to the accompanying drawings.

Figure 1:
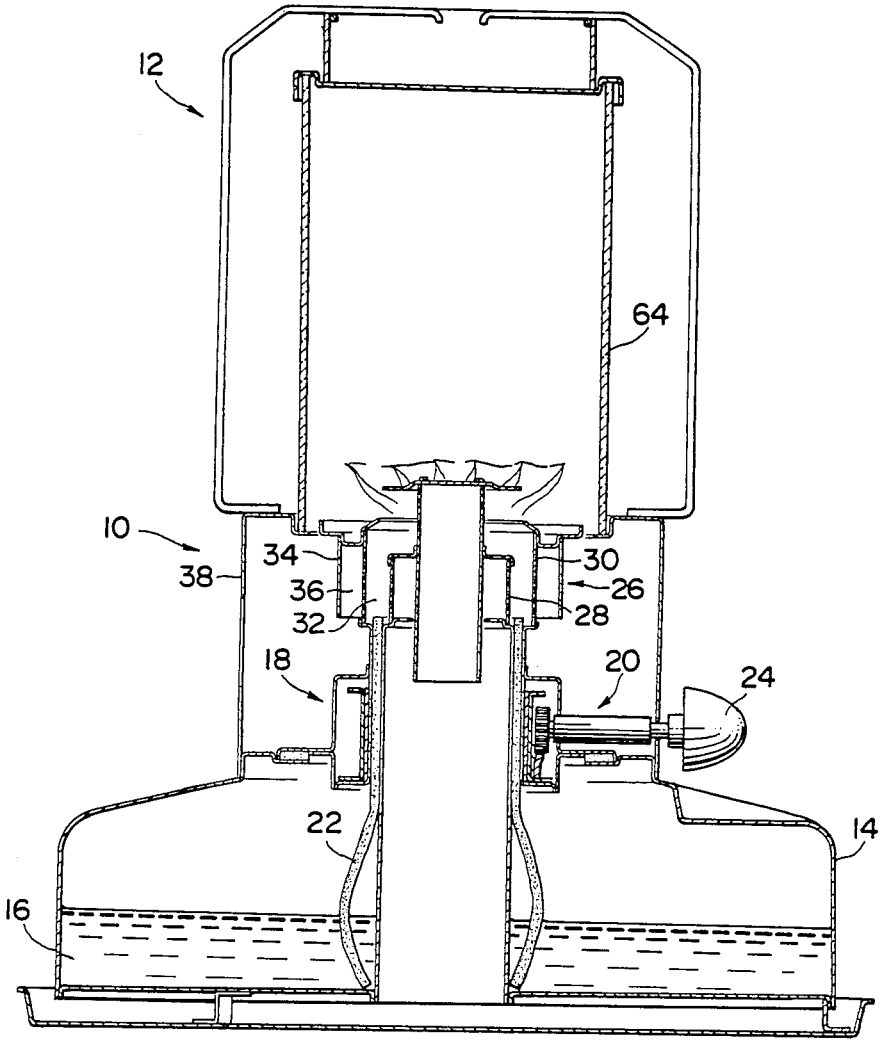
FIG. 1 is a vertical sectional view showing an example of an oil burner which is adapted to incorporate a combustion cylinder structure according to the present invention therein.

FIG. 1 illustrates an oil burner of the wick ignition type which is adapted to incorporate a combustion cylinder structure according to the present invention therein. The oil burner generally designated by reference numeral 10 in FIG. 1 may be constructed in such a manner as widely known in the art, except a combustion cylinder structure of the present invention generally indicated by reference numeral 12.

The oil burner 10 includes an oil reservoir 14 for storing fuel oil 16 such as kerosene and a wick receiving cylinder structure 18 communicated with the oil reservoir 14. At the wick receiving cylinder structure 18 is provided a wick driving mechanism 20 which is adapted to vertically move a wick 22 through a knob 24. The wick 22 is constantly dipped at a lower portion thereof into the fuel oil 16 in the oil reservoir 14.

Figure 2:
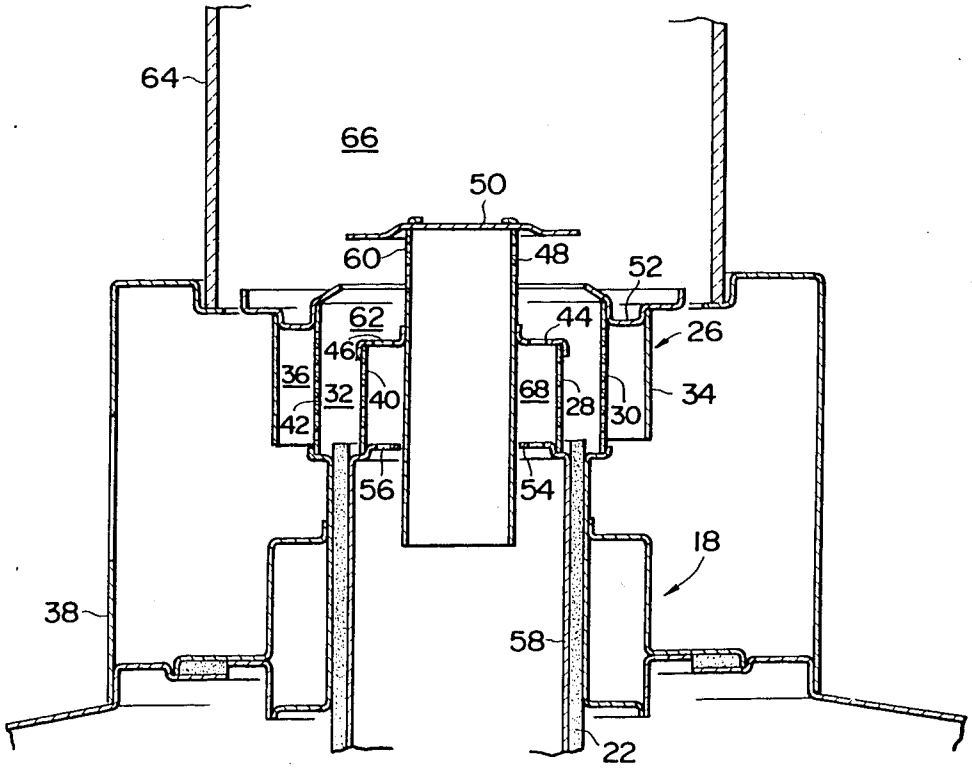
FIG. 2 is a fragmentary enlarged vertical sectional view showing an embodiment of a combustion cylinder structure according to the present invention.

The combustion cylinder structure 12 of the illustrated embodiment, as shown in FIGS. 1 and 2, is constructed in such a manner that a flame spreading section and a multiple combustion cylinder section are integral. The combustion cylinder structure 12 is arranged on the wick receiving cylinder structure 18 and includes a multiple combustion cylinder 26 comprising an inner cylindrical member 28 and an outer cylindrical member 30 which are arranged in a manner to be concentric with each other to define a space 32 therebetween. The multiple combustion cylinder 26 also includes an outermost cylinder 34 arranged so as to surround the outer cylindrical member 30 through an annular space 36 defined therebetween. The inner and outer cylindrical members 28 and 30 and outermost cylinder 34 are supported on the wick receiving cylinder structure 18 and are surrounded together with the structure 18 by an cylindrical casing 38 which is provided with an air introduction holes and may be formed of a steel plate. The inner and outer cylindrical members 28 and 30 are formed with a plurality of small through-holes 40 and 42, as shown in FIG. 2. On a top of the inner cylindrical member 28 is mounted an inner top plate 44 of an annular shape which inwardly extends from the top of the member 28 and is formed with a plurality of small through-holes 46.

The combustion cylinder structure 12 also includes a flame spreading cylinder 48 fixedly fitted in the inner top plate 44 of the inner cylindrical member 40 and extending vertically from the multiple combustion cylinder 26. On an upper end of the flame spreading cylinder 48 is mounted a flame spreading plate 50 if a circular shape of which an outer peripheral end extends to a position above the space 32 between the inner cylindrical member 28 and the outer cylindrical member 30.

On an upper end of the outermost cylinder 34 is mounted an outer top plate 52 of an annular shape. In the illustrated embodiment, the outer top plate 52 is supported on both the outermost cylinder 34 and outer cylindrical member 30 and arranged in such a manner that its outer end outwardly extends from the outermost cylinder 34 and its inner end inwardly extends from the outer cylindrical member 30 so as to terminate above the space 32. In an lower end of the inner cylindrical member 28 is fixedly fitted an annular partition plate 54 formed with a plurality of through-holes 56.

The flame spreading cylinder 48 is arranged so as to extend upwardly through the inner top plate 44 to a position above the outer top plate 52 and downwardly through the partition plate 54 into a central cylindrical member 58 constituting an inner cylinder of the wick receiving cylinder structure. In the illustrated embodiment, the inner cylinder 58 is common to both the oil reservoir 14 and wick receiving cylinder structure 18.

The flame spreading cylinder 48 is formed at only a portion thereof in proximity to the flame spreading plate 50 with a plurality of vent holes 60. The vent holes 60 are preferably arranged above the outer top plate 52. The vent holes may comprise a plurality of small through-holes in a row or in rows. Alternatively, they may comprise a plurality of slits in a row.

A space 62 defined by cooperation of the flame spreading cylinder 48, the outer top plate 52 and the inner top plate 44 is supplied thereto combustion air from an ambient atmosphere through the central cylindrical member 58, the through-holes 56 of the partition plate 54 and the through-holes 46 of the inner top plate 44.

In the illustrated embodiment, the partition plate 54 mounted in the inner cylindrical member 28 may be constituted by a top plate of the central cylindrical member 58. Also, the flame spreading cylinder 48 may be securely supported by the partition plate 54 as well as or instead of the inner top plate 44. Alternatively, the partition plate 54 may be used for positioning the flame spreading cylinder 48. The partition plate 54 serves to control flow of air supplied therethrough to the through-holes 28 and 46 of the inner cylindrical member 28 and inner top plate 44.

The flame spreading plate or disc 50 is surrounded by a heat-permeable cylinder 64, resulting in a space 66 being defined therein which acts as a combustion chamber. In the illustrated embodiment, the flame spreading cylinder 48 extends at its upper end into a lower portion of the combustion chamber 66. The heat-permeable cylinder 64 may be formed of a transparent or translucent material such as glass or the like.

Now, the manner of operation of the combustion cylinder structure of the illustrated embodiment described above will be described hereinafter with reference to the drawings.

When the wick 22 is raised to an ignited position through the wick driving mechanism 20 and then ignited by means of an ignition device (not shown). Air introduced from an ambient atmosphere through the central cylindrical member 58 and the through-holes 56 of the partition plate 54 to the inner cylindrical member 28 is supplied via the through-holes 40 of the inner cylindrical member 28 to the space 32 between the outer cylindrical member 30 and the inner cylindrical member 28. Concurrently, air introduced from an ambient atmosphere through the cylindrical casing 38 to the space 36 between the outermost cylinder 34 and the outer cylindrical member 30 is supplied via the through-holes 42 of the outer cylindrical member 30 to the space 32. This causes a part of fuel oil gas vaporized from the wick 22 to be burned using the so-supplied air, resulting in the fuel oil gas of a high molecular weight being decomposed into combustible gas of a low molecular weight.

The combustible gas thus obtained in the space 32 between the inner cylindrical member 28 and the outer cylindrical member 30 is directed toward the flame spreading cylinder 48 by the outer top plate 52. Concurrently, air is supplied via the small through-holes 46 of the inner top plate 44 to the space 62 defined by cooperation of the outer top plate 52, the flame spreading cylinder 48 and the inner top plate 44. Further, the combustible gas is heated to a high temperature by combustion heat due to the abovedescribed combustion in the space 32, resulting in being upwardly guided while being upwardly forced by air supplied via the through-holes 46 of the inner top plate 44. Air introduced from an ambient atmosphere through the central cylindrical member 58 to the flame spreading cylinder 48 is then guided through the vent holes 60 concentratedly formed at the portion of the cylinder 48 in proximity to the flame spreading disc 50 and then along an lower surface of the flame spreading disc 50. Thus, the combustible gas is burned at a periphery of the flame spreading disc using the air supplied and guided in such a manner as described above, resulting in forming a white-yellow flame at the flame spreading disc as shown in FIG. 1. Heat rays emitted from the so-formed white yellow flame are discharged through the heat-permeable cylinder 64 for space heating. Also, combustion gas of a high temperature produced by the flame is outwardly discharged through a top of the combustion chamber 66 for space heating.

As can be seen from the foregoing, in the illustrated embodiment, the flame spreading cylinder 48 is arranged so as to extend not only above the inner cylindrical member 28 but below the member 28, resulting in the number of parts used being highly decreased as compared with the prior art. In such construction of the illustrated embodiment, it is required to carry out supply of air to the through-holes 40 of the inner cylindrical member 28 utilizing a gap 68 between the flame spreading cylinder 48 and the inner cylindrical member 28. This results in the flame spreading cylinder 48 used being limited to a diameter reduced sufficiently to cause the gap 68 to ensure smooth and satisfactory supply of air to the through-holes 40. However, such limitation of the diameter of the flame spreading cylinder 48 has a possibility of reducing the amount of air supplied therethrough to the flame spreading disc or plate 50 to lead to incomplete combustion in the combustion chamber 66.

In order to avoid such a problem, in the illustrated embodiment, the vent holes 60 of the flame spreading cylinder 48 are concentratedly arranged at only the portion of the flame spreading cylinder 48 above the outer top plate and in proximity to the flame spreading disc 50, to thereby ensure supply of a sufficient amount of air to the flame spreading disc 50. Thus, the illustrated embodiment permits a sufficient amount of air to be supplied to the flame spreading disc 50 and therefore the combustion chamber 66. Also, the flame spreading cylinder 48 is obliged to be reduced in diameter as described above, so that the inner top plate 44 may be increased in area, resulting in much air being supplied via the through-holes 46 of the inner top plate 44 to the space 62. Further, the through-holes 56 of the partition plate 54 control flow of air supplied from the central cylindrical member 58 to the gap 68. Such construction further ensures supply of a sufficient amount of air to the combustion chamber 66.

As can be seen from the foregoing, the present invention is so constructed that the flame spreading cylinder is arranged so as to vertically extend through the combustion cylinder structure upwardly into the combustion chamber and downwardly into the wick receiving cylinder structure. Such construction permits the multiple combustion cylinder structure to be concentrically held without using any cross pin, so that it may decrease the number of used parts to lead to simplification in manufacturing and assembling of the structure and ensure formation of a stable and uniform flame in the combustion chamber.

Also, the present invention ensures effectively eliminates deterioration of combustion performance.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to be fall therebetween.

What is claimed is:

1. A combustion cylinder structure for an oil burner comprising:

a multiple combustion cylinder comprising a perforated inner cylindrical member, a perforated outer cylindrical member and an outermost cylinder concentrically arranged together so as to define first and second spaces therebetween, respectively, said multiple combustion cylinder being supported on a wick receiving cylinder structure of said oil burner;

a combustion chamber defined above said multiple combustion cylinder;

an inner top plate of an annular shape mounted on said inner cylindrical member so as to inwardly extend therefrom;

a partition plate of an annular shape fitted in a lower end of said inner cylindrical member;

a flame spreading cylinder fixedly arranged in said inner cylindrical member so as to upwardly extend through said top inner plate and inner cylindrical member into said combustion chamber;

a flame spreading plate of a circular shape mounted on an upper end of said flame spreading cylinder and arranged in said combustion chamber, said flame spreading plate having an outer periphery extending to a position above said first space between said inner cylindrical member add said outer cylindrical member;

an outer top plate of an annular shape mounted on an upper end of said outer cylindrical member and having an inner peripheral end of said outer top plate extending to a position above said first space and positioned between said inner top plate and said flame spreading plate;

said flame spreading cylinder downwardly extending through said partition plate into said wick receiving cylinder structure;

said flame spreading cylinder being concentratedly formed with a plurality of vent holes at a portion thereof in proximity to said flame spreading plate;

said partition plate being formed with a plurality of small through-holes;

said inner top plate being formed with a plurality of small through-holes;

said flame spreading cylinder, outer top plate and inner top plate cooperating together to define a space to which air is supplied via said small through-holes of said partition plate and inner top plate.

2. A combustion cylinder structure as defined in claim 1, wherein said outer top plate is arranged so as to outwardly extend to at least an upper end of said outer cylindrical member.

3. A combustion cylinder structure as defined in claim 1, wherein said vent holes comprise a plurality of small through-holes in at least a row.

4. A combustion cylinder structure as defined in claim 1 wherein said vent holes comprise a plurality of slits in a row.

5. A combustion cylinder structure as defined in claim 1, wherein said partition plate comprises a top plate of an inner cylinder of a wick receiving cylinder structure of said oil burner.

6. A combustion cylinder structure as defined in claim 1, wherein said flame spreading cylinder is held by said inner top plate.

7. A combustion cylinder structure as defined in claim 1, wherein said flame spreading cylinder is held by said inner top plate and said partition plate.

* * * * *

UNITED STATES PATENT AND TRADEMARK OFFICE

CERTIFICATE OF CORRECTION

PATENT NO. : 4,846,672

DATED : July 11, 1989

INVENTOR(S) : Kawamura, et al.

It is certified that error appears in the above-identified patent and that said Letters Patent is hereby corrected as shown below:

Column 6, line 53, change "add" to --and--.

Signed and Sealed this

Twenty-fourth Day of April, 1990

*Attest:*

HARRY F. MANBECK, JR.

*Attesting Officer*

*Commissioner of Patents and Trademarks*